US008398374B2

(12) United States Patent
Roberts et al.

(10) Patent No.: US 8,398,374 B2
(45) Date of Patent: Mar. 19, 2013

(54) METHOD AND APPARATUS FOR A SEGMENTED TURBINE BUCKET ASSEMBLY

(75) Inventors: Herbert Chidsey Roberts, Simpsonville, SC (US); John Ellington Greene, Greenville, SC (US)

(73) Assignee: General Electric Company, Schenectady, NY (US)

( * ) Notice: Subject to any disclaimer, the term of this patent is extended or adjusted under 35 U.S.C. 154(b) by 374 days.

(21) Appl. No.: 12/694,834

(22) Filed: Jan. 27, 2010

(65) Prior Publication Data

US 2011/0182738 A1 Jul. 28, 2011

(51) Int. Cl.
*F01D 5/28* (2006.01)

(52) U.S. Cl. ..... 416/193 R; 416/223 A

(58) Field of Classification Search ..... 416/224, 416/228, 223 A, 210 A, 204 A, 195, 196 R, 416/193 R, 219 R; 415/12; 29/889.1
See application file for complete search history.

(56) References Cited

U.S. PATENT DOCUMENTS

| | | | | |
|---|---|---|---|---|
| 6,471,485 | B1 * | 10/2002 | Rossmann et al. | 416/230 |
| 6,908,288 | B2 * | 6/2005 | Jackson et al. | 416/224 |
| 2010/0135812 | A1 * | 6/2010 | Cairo et al. | 416/223 A |
| 2010/0150727 | A1 * | 6/2010 | Brandl et al. | 416/223 A |

FOREIGN PATENT DOCUMENTS

| | | | |
|---|---|---|---|
| JP | 58005402 A | * | 1/1983 |
| JP | 59122703 A | * | 7/1984 |

OTHER PUBLICATIONS

JP59122703A Translation. Apr. 2012. Schreiber Translations, Inc. Washington D.C. 20 pages.*

* cited by examiner

*Primary Examiner* — Richard Edgar
(74) *Attorney, Agent, or Firm* — Armstrong Teasdale LLP

(57) ABSTRACT

A turbine bucket that includes a platform and an airfoil extending radially outward from the platform. The airfoil includes a root segment and a tip segment. The root segment includes a first end and a second end. The root first end extends from a radially outer surface of the platform. The root segment extends from the root first end to the root second end. The tip segment includes a tip first end and a tip second end. The tip first end is removably coupled to the root second end. The tip segment extends outward from the root second end to the tip second end.

20 Claims, 4 Drawing Sheets

METHOD AND APPARATUS FOR A SEGMENTED TURBINE BUCKET ASSEMBLY

BACKGROUND OF THE INVENTION

The embodiments described herein relate generally to turbine buckets, and more particularly, to methods and apparatus for use in assembling a segmented airfoil of a turbine bucket.

At least some known gas turbine engines include a combustor, a compressor, and/or turbines that include a rotor disk that includes a plurality of rotor blades, or buckets, that extend radially outward therefrom. The plurality of rotating turbine blades or buckets channel high-temperature fluids, such as combustion gases or steam, through either a gas turbine engine or a steam turbine engine. The root segments of at least some known buckets are coupled to the disk with a dovetail that is inserted within a dovetail slot formed in the rotor disk. Because such turbine engines operate at relatively high temperatures and may be relatively large, the operating capacity of such an engine may be at least partially limited by the materials used in fabricating the buckets and/or the length of the airfoil portions of the buckets. To facilitate enhanced performance, at least some engine manufacturers have increased the size of the engines, thus resulting in an increase in the length of the airfoil portion of the buckets. Such an increase can require the size of the dovetails and the dovetail slots to be increased to ensure the longer buckets are retained in position.

Moreover, the tip portion of the airfoil of the rotor blades may be exposed to significantly higher temperatures than the root portion of the same airfoil, which may cause the blade tips to prematurely fail over time. Such failures can require replacement of the damaged turbine bucket. In the case of a "blisk", such failures can require expensive replacement and/or refurbishment of the entire "blisk". As such, a turbine bucket with a repairable and/or replaceable airfoil tip portion could reduce maintenance costs and reduce the operational issues related to ever-increasing lengths of the airfoil portion of turbine buckets.

BRIEF DESCRIPTION OF THE INVENTION

In one aspect a turbine bucket is provided. The turbine bucket includes a platform and an airfoil extending radially outward from the platform. The airfoil includes a root segment and a tip segment. The root segment includes a first end and a second end. The root first end extends from a radially outer surface of the platform. The root segment extends from the root first end to the root second end. The tip segment includes a tip first end and a tip second end. The tip first end is removably coupled to the root second end. The tip segment extends outward from the root second end to the tip second end.

In another aspect, a method for assembling a turbine bucket is provided. The method includes removably coupling an airfoil tip segment to a root segment of the airfoil, wherein the root segment is coupled to a radially outer platform of the turbine bucket.

In yet another aspect, a gas turbine engine system is provided. The gas turbine engine system includes a compressor, a combustor in flow communication with the compressor to receive at least some of the air discharged by the compressor, a rotor shaft rotatably coupled to the compressor, and a turbine bucket coupled to the rotor shaft. The turbine bucket includes a platform and an airfoil extending radially outward from the platform. The airfoil includes a root segment and a tip segment. The root segment includes a first end and a second end. The root first end extends from a radially outer surface of the platform. The root segment extends from the root first end to the root second end. The tip segment includes a tip first end and a tip second end. The tip first end is removably coupled to the root second end. The tip segment extends outward from the root second end to the tip second end.

DETAILED DESCRIPTION OF THE INVENTION

As used herein, the term "turbine blade" is used interchangeably with the term "bucket" and thus can include any combination of a bucket including a platform and dovetail and/or a bucket integrally formed with the rotor disk, both of which include at least one airfoil segment.

Figure 1:
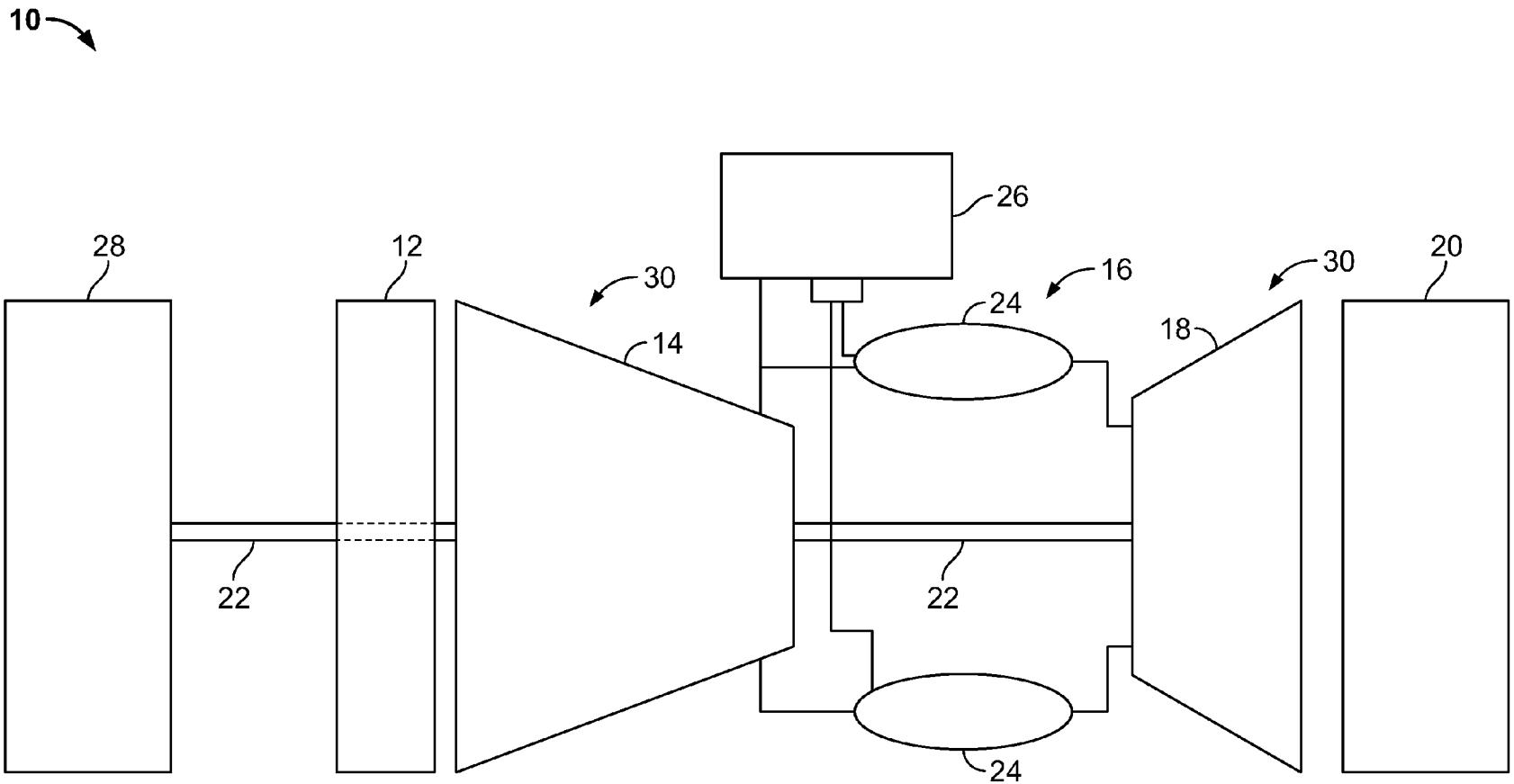
FIG. 1 is a schematic view of an exemplary gas turbine engine system.

FIG. 1 is a schematic view of an exemplary gas turbine engine system 10. In the exemplary embodiment, gas turbine engine system 10 includes an intake section 12, a compressor section 14 downstream from the intake section 12, a combustor section 16 coupled downstream from the intake section 12, a turbine section 18 coupled downstream from the combustor section 16, and an exhaust section 20. Turbine section 18 is drivingly coupled to compressor section 14 via a rotor shaft 22. Combustor section 16 includes a plurality of combustors 24. Combustor section 16 is coupled to compressor section 14 such that each combustor 24 is in flow communication with the compressor section 14. Fuel nozzle assembly 26 is coupled to each combustor 24. Turbine section 18 is rotatably coupled to compressor section 14 and to a load 28 such as, but not limited to, an electrical generator and a mechanical drive application. In the exemplary embodiment, compressor section 14 and turbine section 18 each include at least one turbine blade or bucket 30 coupled to rotor shaft 22 that include airfoil portions.

During operation, intake section 12 channels air towards compressor section 14. Compressor section 14 compresses the inlet air to higher pressures and temperatures and discharges the compressed air towards combustor section 16 wherein it is mixed with fuel and ignited to generate combustion gases that flow to turbine section 18, which drives compressor section 14 and/or load 28. Specifically, at least a portion of the compressed air is supplied to fuel nozzle assembly 26. Fuel is channeled to fuel nozzle assembly 26 wherein the fuel is mixed with the air and ignited downstream of fuel nozzle assembly 26 in combustor section 16. Combustion gases are generated and channeled to turbine section 18 wherein gas stream thermal energy is converted to mechanical rotational energy. Exhaust gases exit turbine section 18 and flow through exhaust section 20 to ambient atmosphere.

Figure 2:
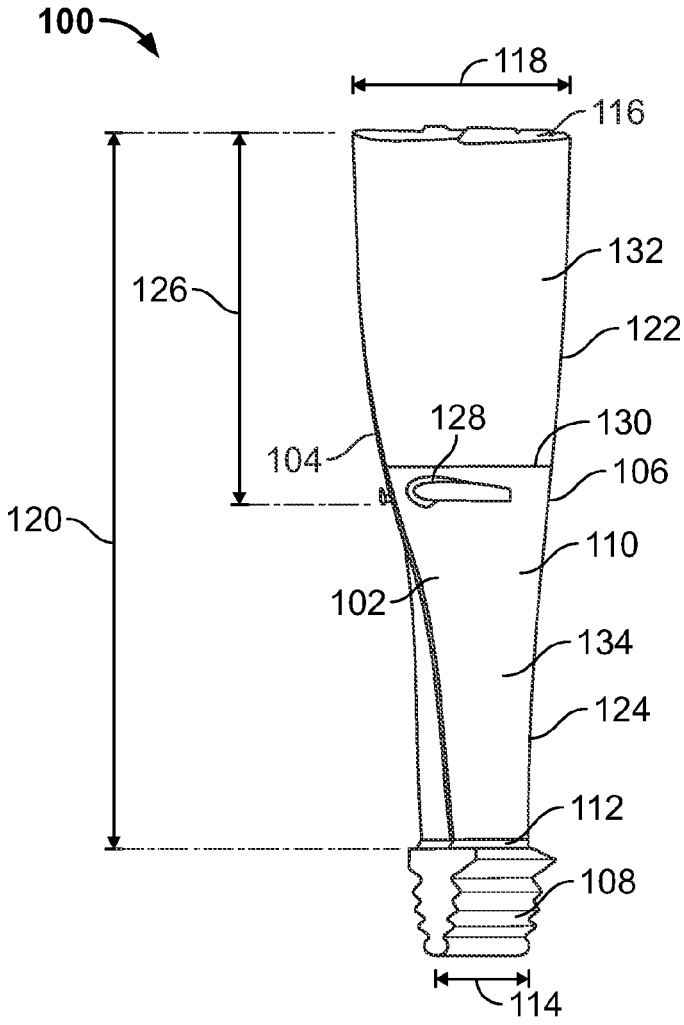
FIG. 2 is a perspective view of an exemplary turbine bucket that may be used with the turbine engine shown in FIG. 1.

FIG. 2 is a perspective view of a turbine bucket 100 that may be used with gas turbine engine system 10 (shown in FIG. 1). Turbine bucket 100 includes a pressure side 102 and a suction side (not shown in FIG. 2) connected together at a leading edge 104 and a trailing edge 106. Pressure side 102 is generally concave and the suction side is generally convex. Turbine bucket 100 includes a dovetail 108, an airfoil 110, and a platform 112 extending therebetween. In the exemplary embodiment, turbine bucket 100 couples to rotor shaft 22 (shown in FIG. 1) via dovetail 108 and extends radially outward from rotor shaft 22. In an alternative embodiment, turbine bucket 100 may be coupled to rotor shaft 22 by other devices configured to couple a bucket to a rotor shaft, such as, a blisk.

Bucket dovetail 108 has an axial length 114 that facilitates securing turbine bucket 100 to rotor shaft 22. As rotor shaft 22 may vary in size, length 114 may also vary to facilitate providing optimal performance of turbine bucket 100 and, more specifically, gas turbine engine system 10. Platform 112 extends radially outward from dovetail 108 and has a length that is approximately equal to dovetail length 114. Airfoil 110 extends radially outward from a radially outer surface of platform 112 and also has an initial length that is approximately equal to dovetail length 114. Notably, in the exemplary embodiment, platform 112 and airfoil 110 are fabricated unitarily together such that there are no seams or inconsistencies in turbine bucket 100 where platform 112 transitions to airfoil 110.

Airfoil 110 extends radially outward from platform 112 and increases in length to a tip end 116 of turbine bucket 100. In the exemplary embodiment, tip end 116 has a length 118 that is longer than length 114. Airfoil 110 also has a width (not shown) sized to facilitate locking a snub cover (not shown). As such, tip length 118 and the tip width may vary depending on the application of turbine bucket 100 and, more specifically, gas turbine engine system 10. Airfoil 110 has a first or radial length 120 measured from platform 112 to tip end 116. Radial length 120 is selected to facilitate optimizing performance of turbine bucket 100. As such, bucket length 120 may also vary depending on the application of turbine bucket 100 and, more specifically, gas turbine engine system 10.

In the exemplary embodiment, airfoil 110 includes a first or tip segment 122 coupled to a second or root segment 124 to form airfoil 110 having radial length 120. In the exemplary embodiment, tip segment 122 includes a second radial length 126 that is less than airfoil radial length 120 of airfoil 110. In one embodiment, tip segment radial length 126 equals about 50 percent radial length 120. In another embodiment, tip segment radial length 126 equals greater than 50 percent of radial length 120. In a further embodiment, tip segment radial length 126 is less than 50 percent of radial length 120. In an alternative embodiment, airfoil 110 includes at least one damper 128 coupled to tip segment 122 and/or root segment 124 to facilitate dampening vibrations in airfoil 110 and/or to facilitate providing structural support to airfoil 110 during operation of gas turbine engine system 10. In one embodiment, damper 128 is coupled to and between tip segment 122 and/or root segment 124 for selectively preventing tip segment 122 from uncoupling from root segment 124.

In the exemplary embodiment, tip segment 122 is coupled to root segment 124 at a joint 130. In one embodiment, joint 130 is an axial joint. As used herein, the term "axial joint" is used to describe a joint that is formed along an axial length of a cross-section of airfoil 110. In another embodiment, joint 130 is a circumferential joint. As used herein, the term "circumferential joint" is used to describe a joint that is formed along the circumferential width of airfoil 110. In other embodiments, the joint 130 may include one of a dovetail joint, a dado joint, and/or a box joint. Moreover, in other embodiments, joint 130 may include other joint types known to one skilled in the art that enable tip segment 122 to be removably coupled to root segment 124 as described herein.

In the exemplary embodiment, tip segment 122 is formed using a first material 132. Root segment 124 is formed using a second material 134 that is different than first material 132. More specifically, in the exemplary embodiment, tip segment 122 is formed from a material that has a density that is less than the density of the material of root segment 124. Use of a less dense material enables tip segment 122 to weigh less than root segment 124. As such, the rotating mass of turbine bucket 100 is facilitated to be decreased. Moreover, because the operating temperature at tip end 116, or at tip segment 122, may be higher than the operating temperature at root segment 124, in the exemplary embodiment, the material used for tip segment 122 may have a higher heat resistance and/or an increased heat tolerance than the material used to fabricate root segment 124. For example, in one embodiment, tip segment 122 may be partially fabricated from a lightweight ceramic material. Using a lighter material may also facilitate reducing structural loading induced to root segment 124 and/or may enable a vibratory response of the assembled airfoil 110 to be controlled by using material in tip segment 122 that has a vibratory response that is different than the vibratory response of root segment 124. Additionally, the use of a denser material in root segment 124 and a lighter material in tip segment 122 can facilitate reducing the failure of root segment 124 by reducing the need to trade-off the overall strength of a monolithic airfoil for weight savings of the monolithic airfoil.

Furthermore, additional benefits are realized when using airfoil 110. More specifically, when tip segment 122, is damaged by, for example, through a tip-rub event, through overheating, and/or any other damaging event, tip segment 122 can be repaired or replaced by itself without requiring more expensive and more time-consuming removal and repair/replacement of the complete turbine bucket 100. Such cost savings facilitate reducing the overall operating and maintenance costs of the gas turbine engine system 10, as well as reducing the length of time gas turbine engine system 10 is out-of-service for such repairs.

Figure 3A:
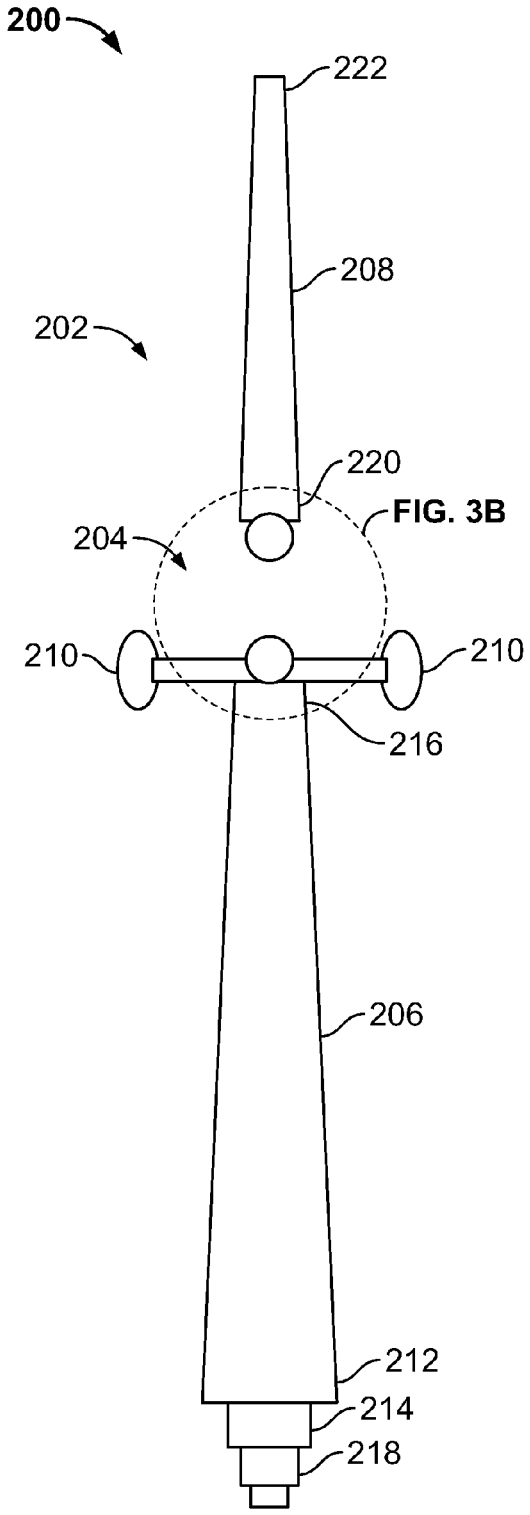
FIG. 3A is side schematic view of an alternative turbine bucket that may be used with the turbine engine shown in FIG. 1.
Figure 3B:
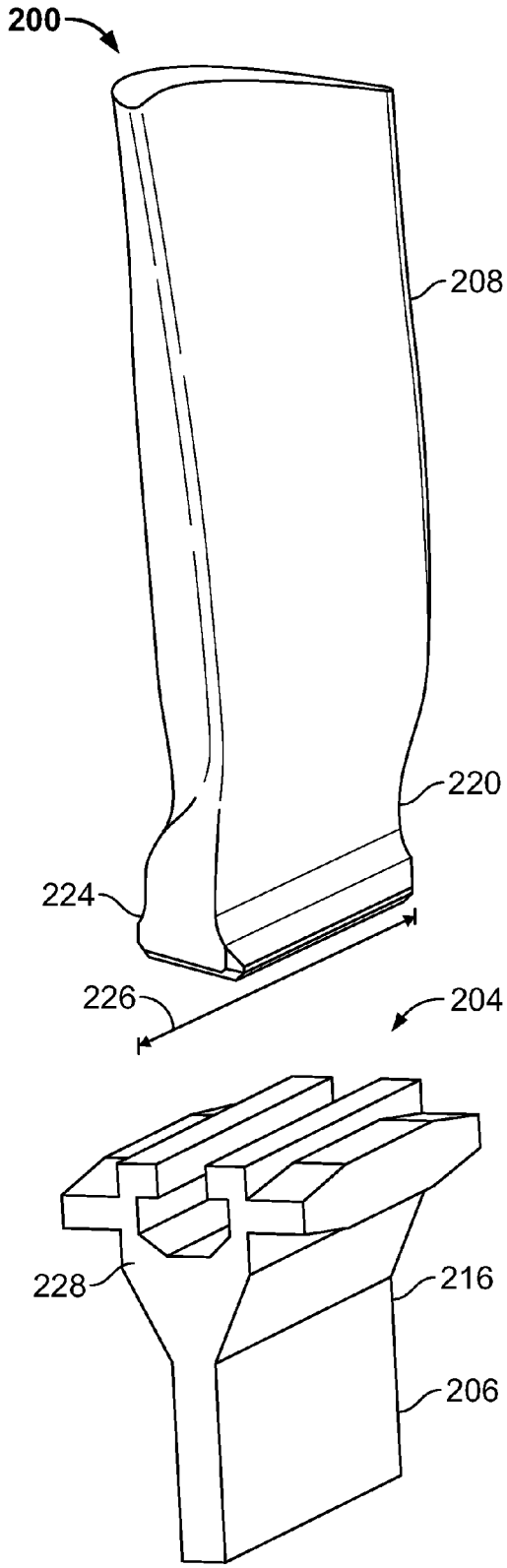
FIG. 3B is an enlarged perspective view of the turbine bucket shown in FIG. 3A.

FIG. 3A is a schematic view of an alternative turbine bucket 200 that may be used with gas turbine engine system 10. FIG. 3B is an enlarged perspective view of the turbine bucket 200. In the alternative embodiment, turbine bucket 200 includes an airfoil 202 having at least one joint 204. FIG. 3B is an enlarged view of turbine bucket 200 at joint 204. In the alternative embodiment, airfoil 202 includes a root segment 206, a tip segment 208, and at least one damper 210 coupled to root segment 206. A first end 212 of root segment 206 is coupled to a platform 214. Root segment 206 extends radially outward from platform 214 to a second end 216 of root segment 206. In this alternative embodiment, platform 214 is coupled to a dovetail portion 218. Dovetail portion 218 is sized, shaped, and oriented to couple airfoil 202 to a turbine disk (not shown) in gas turbine engine system 10 (shown in FIG. 1). In an alternative embodiment, platform 214 and root segment 206 are formed integrally with the turbine disk in a "blisk" configuration. Damper 210 is coupled to second end 216 of root segment 206. In one embodiment, damper 210 is formed integrally with root segment 206.

In the alternative embodiment, tip segment 208 includes a first end 220 and a second end 222. First end 220 is removably coupled to the second end 216 of root segment 206. Tip segment 208 is removably coupled to root segment 206 at joint 204. In the alternative embodiment, tip segment first end 220 includes a dovetail portion 224 extending along an axial length 226 of airfoil 202. Root segment second end 216 includes a dovetail groove 228 extending along axial length 226. Dovetail groove 228 is sized and shaped to receive at least a portion of dovetail portion 224 to form joint 204.

Figure 4A:
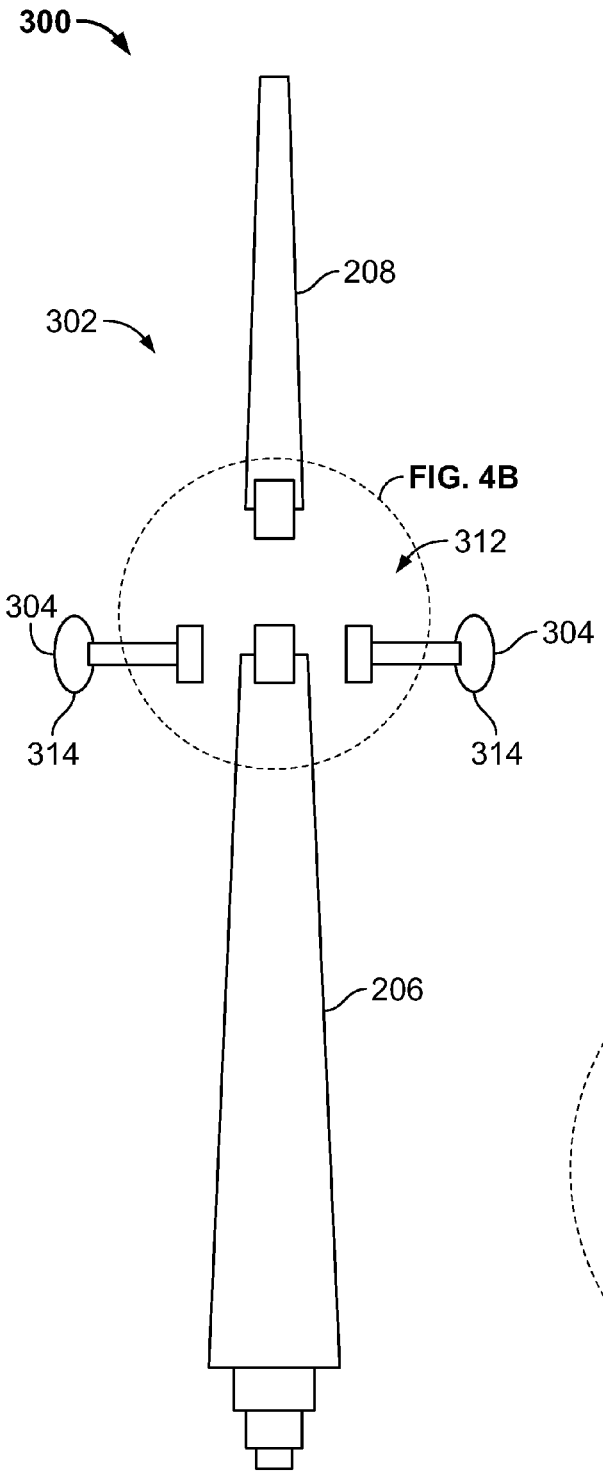
FIG. 4A is a side schematic view of an alternative turbine bucket that may be used with the turbine engine shown in FIG. 1.
Figure 4B:
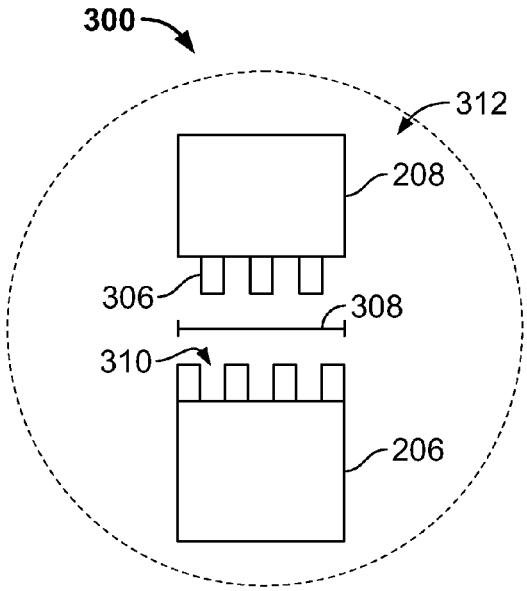
FIG. 4B is an enlarged perspective view of the turbine bucket shown in FIG. 4A.

FIG. 4A illustrates a perspective view of an alternative embodiment of a turbine bucket 300 that may be used with turbine engine 10 (shown in FIG. 1). FIG. 4B illustrates an enlarged perspective view of turbine bucket 300. Components shown in FIG. 3A are labeled with the same reference numbers in FIG. 4A and FIG. 4B. In the alternative embodiment, turbine bucket 300 includes an airfoil 302. Airfoil 302 includes at least one damper 304 that is removably coupled to either root segment 206 and/or tip segment 208, such that damper 304 maintains a position of root segment 206 relative to tip segment 208. In the alternative embodiment, tip segment 208 includes at least one projection 306 extending radially outward from tip segment 208 and oriented circumferentially along an a circumferential width 308 of airfoil 302. Root segment 206 includes at least one slot 310 oriented circumferentially along width 308 and corresponding to projection 306. In the alternative embodiment, slot 310 is sized and shaped to receive projection 306 to form a joint 312. In one embodiment projection 306 includes a dovetail shape and slot 310 includes a corresponding dovetail groove. In the alternative embodiment, damper 304 includes two damper segments 314 that are coupled together and that are also coupled to root segment 206, to tip segment 208, and to joint 312 such that damper 304 enables root segment 206 to be removably coupled to tip segment 208. In such an embodiment, damper 304 functions as a clamp and/or a joint key to maintain joint 312 in a coupled manner such that decoupling of root segment 206 and tip segment 208 is prevented, and such that tip segment 208 and root segment 206 may only be decoupled when damper 304 is removed.

Figure 5:
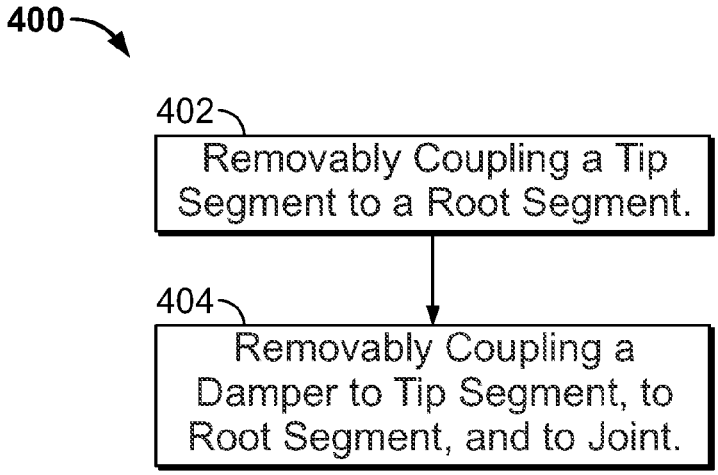
FIG. 5 is a flow chart illustrating an exemplary method for assembling a turbine bucket that includes a segmented airfoil.

FIG. 5 is a flow chart illustrating an exemplary method 400 for assembling turbine bucket 100. In the exemplary embodiment, first end 220 of tip segment 208 is removably coupled 402 to second end 216 of root segment 206. In one embodiment, coupling 402 is accomplished using at least one of an axial joint 204 and a circumferential joint 312. In other embodiments, the coupling 402 can be accomplished using a dovetail joint, a dado joint, a box joint, and/or a tongue-and-groove joint. In the exemplary embodiment, at least one damper 304 is removably coupled 404 to at least one of the tip segment 208, the root segment 206, and/or the joint 312 such that the damper 304 facilitates coupling 404 the root segment 206 to the tip segment 208. In the exemplary embodiment, the damper 304 maintains a position of the root segment 206 with respect to the tip segment 208. Moreover, in such an embodiment, the damper 304 functions as a clamp and/or a joint key to prevent the root segment 206 from being inadvertently decoupled from the tip segment 208, and to ensure that the tip segment 208 and the root segment 206 may only be decoupled when the damper 304 is removed.

Moreover, in the exemplary embodiment, the tip segment 208 that is removably coupled 402 to the root segment 206 is fabricated at least partially with a material having a different density than the density of the material used to fabricate at a portion of the root segment 206. More specifically, in the exemplary embodiment, the tip segment 208 is fabricated at least partially with a material that is less dense than the density of the material used to fabricate at least a portion of the root segment 206, such that the tip segment 208 weighs less than the root segment 206. By coupling 402 a tip segment 208 having a lower density to the root segment 206, the overall rotational mass of the assembled airfoil 110 is reduced. As such, the overall rotational mass of the turbine is also reduced. Assembling a segmented airfoil using the methods described here facilitates reducing an amount of time used to repair, to refurbish, and/or to replace a failed or damaged turbine bucket.

The above-described methods and apparatus facilitate assembling a turbine bucket having a reduced rotating mass. More specifically, by assembling a turbine bucket having a tip segment and a root segment, the tip segment may be formed using materials that include a density that is less than the density of the root segment. Moreover, because the operating temperature at the tip segment of a turbine bucket may be higher than the operating temperature at the root segment, the tip segment may be formed from material having a higher heat resistance and/or an increased heat tolerance than the material used to fabricate the root segment. Furthermore, when the tip segment is damaged by, for example, through a tip-rub event, the tip segment can be repaired or replaced without requiring the complete removal of the turbine bucket. As such, the cost of maintaining the gas turbine engine system is facilitated to be reduced.

Although the exemplary apparatus and methods described herein are described in the context of assembling a segmented airfoil for a gas turbine engine, it should be understood that the apparatus and methods are not limited to use with only a gas turbine engine. For example, the fixture described herein can be used with a plurality of turbines, as well as any device using airfoils, regardless of whether the airfoils are rotating or stationary. As such, those skilled in the art will recognize that the claims and described embodiments can be practiced with modification within the spirit and scope of the claims.

Exemplary embodiments of methods and apparatus for a segmented turbine bucket assembly are described above in detail. The methods And apparatus are not limited to the specific embodiments described herein, but rather, components of systems and/or steps of the method may be utilized independently and separately from other components and/or steps described herein. For example, the methods and apparatus may also be used in combination with other combustion systems and methods, and are not limited to practice with only the gas turbine engine assembly as described herein. Rather, the exemplary embodiment can be implemented and utilized in connection with many other combustion system applications.

Although specific features of various embodiments of the invention may be shown in some drawings and not in others, this is for convenience only. Moreover, references to "one embodiment" in the above description are not intended to be interpreted as excluding the existence of additional embodiments that also incorporate the recited features. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A turbine bucket comprising:

a platform having a first axial length; and an airfoil extending radially outward from said platform, said airfoil comprising a root segment and a tip segment, said root segment comprising a first end and a second end, said root first end extending from a radially outer surface of said platform, said root segment extending from said root first end to said root second end, said tip segment comprising a tip first end and a tip second end, said tip first end removably coupled to said root second end, said tip segment extending outward from said root second end to said tip second end, wherein said tip second end has a second axial length that is longer than said first axial length, said tip segment comprised of a first material, said root segment being comprised of a second material having lower heat resistance than said first material.

2. A turbine bucket in accordance with claim 1, wherein said tip segment is removably coupled to said root segment using one of an axial joint and a circumferential joint.

3. A turbine bucket in accordance with claim 1, wherein said tip segment is removably coupled to said root segment using one of a dovetail joint, a dado joint, a box joint, and a tongue-and-groove joint.

4. A turbine bucket in accordance with claim 1, further comprising at least one damper removably coupled to one of said root segment and said tip segment.

5. A turbine bucket in accordance with claim 4, wherein said at least one damper facilitates maintaining a relative position of said root segment with respect to said tip segment.

6. A turbine bucket in accordance with claim 4, wherein said at least one damper selectively prevents said root segment from uncoupling from said tip segment.

7. A turbine bucket in accordance with claim 1, wherein said first material has a different density than said second material.

8. A turbine bucket in accordance with claim 1, wherein said first material is less dense than said second material.

9. A method for assembling a turbine bucket, said method comprising removably coupling an airfoil tip segment to a root segment of the airfoil, wherein the root segment is coupled to a radially outer platform of the turbine bucket, wherein the tip segment is fabricated from a first material and the root segment is fabricated from a second material that has a lower heat resistance than that of the first material, and wherein the platform has a first axial length and a radially outer end of the tip segment has a second axial length that is longer than the first axial length.

10. A method in accordance with claim 9, wherein said coupling an airfoil tip segment to a root segment of the airfoil further comprises coupling the tip segment to the root segment using one of an axial joint and a circumferential joint.

11. A method in accordance with claim 9, wherein said coupling an airfoil tip segment to a root segment of the airfoil further comprises coupling the tip segment to the root segment using one of a dovetail joint, a dado joint, a box joint, and a tongue-and-groove joint.

12. A method in accordance with claim 9 further comprising removably coupling a damper to one of the root segment and the tip segment.

13. A method in accordance with claim 12, wherein said removably coupling a damper further comprises removably coupling the damper to one of the root segment and the tip segment to facilitate maintaining a position of the root segment with respect to the tip segment.

14. A method in accordance with claim 9, wherein said removably coupling an airfoil tip segment to a root segment of the airfoil further comprises coupling the airfoil tip segment to the root segment, wherein the tip segment is fabricated from said first material that has a density that is different from that of said second material used in fabricating the root segment.

15. A gas turbine engine system comprising:

a compressor;

a combustor in flow communication with said compressor to receive at least some of the air discharged by said compressor, a rotor shaft rotatably coupled to said compressor; and a turbine bucket coupled to said rotor shaft, said turbine bucket comprising:

a platform having a first axial length; and an airfoil extending radially outward from said platform, said airfoil comprising a root segment and a tip segment, said root segment comprising a first end and a second end, said root first end extending from a radially outer surface of said platform, said root segment extending from said root first end to said root second end, said tip segment comprising a tip first end and a tip second end, said tip first end removably coupled to said root second end, said tip segment extending outward from said root second end to said tip second end, wherein said tip second end has a second axial length that is longer than said first axial length, said tip segment comprised of a first material, said root segment comprised of a second material having a lower heat resistance than said first material.

16. A gas turbine engine system in accordance with claim 15, wherein said turbine bucket further comprises at least one damper removably coupled to one of said root segment and said tip segment.

17. A gas turbine engine system in accordance with claim 15, wherein said tip segment is removably coupled to said root segment using one of an axial joint and a circumferential joint.

18. A gas turbine engine system in accordance with claim 15, wherein said tip segment is removably coupled to said root segment using one of a dovetail joint, a dado joint, a box joint, and a tongue-and-groove joint.

19. A gas turbine engine system in accordance with claim 15, wherein said first material has a different density than said second material.

20. A gas turbine engine system in accordance with claim 15, wherein said first material is less dense than said second material.

* * * * *